United States Patent [19]

Ohara et al.

[11] Patent Number: 4,812,439

[45] Date of Patent: Mar. 14, 1989

[54] COLOR INK SHEET FOR THERMAL TRANSFER

[75] Inventors: Shuichi Ohara; Sinichi Akasaka; Hiroyuki Oka; Shintaroo Hattori, all of Hitachi, Japan

[73] Assignee: Hitachi, Ltd., Tokyo, Japan

[21] Appl. No.: 890,608

[22] Filed: Jul. 30, 1986

[30] Foreign Application Priority Data

Aug. 5, 1985 [JP] Japan ..... 60-171079

[51] Int. Cl.[4] ..... B41M 5/035; B41M 5/26

[52] U.S. Cl. ..... 503/227; 8/471; 428/195; 428/211; 428/216; 428/336; 428/913; 428/914

[58] Field of Search ..... 8/470, 471; 346/227; 428/195, 207, 215, 484, 488.1, 488.4, 913, 914, 211, 216, 336, 480, 532; 430/945; 503/227

[56] References Cited

U.S. PATENT DOCUMENTS

| | | | |
|---|---|---|---|
| 4,422,854 | 12/1983 | Hähnle et al. | 8/471 |
| 4,503,095 | 3/1985 | Seto et al. | 8/471 |
| 4,518,988 | 5/1985 | Saitoh et al. | 358/75 |
| 4,541,830 | 9/1985 | Hotta et al. | 8/471 |
| 4,559,273 | 12/1985 | Kutsukake et al. | 8/471 |

FOREIGN PATENT DOCUMENTS

| | | | |
|---|---|---|---|
| 0095380 | 11/1983 | European Pat. Off. | 428/195 |
| 0097493 | 1/1984 | European Pat. Off. | 503/227 |
| 0119275 | 9/1984 | European Pat. Off. | 503/227 |
| 0169894 | 9/1984 | Japan | 346/227 |

OTHER PUBLICATIONS

*IEEE Transactions on Electron Devices,* vol. ED-31, No. 9, Sep. 1984, pp. 1258-1263, "Color Thermal Ink--Transfer Imaging," Ohya et al.

*Primary Examiner*—Bruce H. Hess

*Attorney, Agent, or Firm*—Antonelli, Terry & Wands

[57] ABSTRACT

When the reflection density of the colorants of an ink layer is 1.3 after transfer onto a recording paper, a reflectance of yellow colorant lies in between two diagrams ($D_1$, $D_2$) shown in FIG. 1, a reflectance of magenta colorant lies in between two diagrams ($D_3$, $D_4$) shown in FIG. 2, and a reflectance of cyan colorant lies in between two diagrams ($D_5$, $D_6$) shown in FIG. 3. A color ink sheet realizes an excellent hue, a high luminance factor and high chroma. A wide color specification range and clear image having a high color reproducibility is obtained.

12 Claims, 5 Drawing Sheets

COLOR INK SHEET FOR THERMAL TRANSFER

BACKGROUND OF THE INVENTION

1. Field of the Invention

The present invention relates to a color ink sheet for thermal transfer to be used in color recording by thermal transfer, and more particularly, to color ink sheet for thermal transfer for a color printer comprising an electronic component such as a thermal head.

2. Description of the Prior Art

A thermal transfer recording method has been known as a method of color recording of color image information from a CRT output terminal of a television, video tape recorder, electronic camera, personal computer or the like through electric signals.

A color ink sheet for thermal transfer (hereinafter referred to as the "ink sheet") used in this recording method comprises solid ink layers of at least three colorants, i.e. yellow, magenta and cyan colorants, which can be thermally transferred, the solid ink layers being arranged face to face repeatedly on a base substance such as a paper or plastic sheet.

The inks are transferred onto a recording paper by fusing the same with the heat of a thermal head controlled by image signals or by sublimating or evaporating a subliming dye in the ink. The transfer is effected 1 to 3 times for each of the three colors of yellow, magenta and cyan colorants on same recording paper to record the color image.

The color reproducibility of the color image recorded on the recording paper as compared with the original image varies mainly depending on the colorant contained in the ink layer of the ink sheet. The colorants which are transferred by the fusion of the ink (hereinafter referred to as "fusion-type") include a dye and pigment which are used widely as ordinary colorants. The colorants which are transferred by the sublimation or evaporation of the dye in the ink (hereinafter referred to as "sublimation-type") include a disperse dye having a sublimation function of a sublimating dye such as basic dye.

However, sufficient care is not always taken of the hue or chroma after the transfer of the colorants on the recording paper. Thus, the color specification range or color expression range of the image transferred by means of the current link sheet is narrower and the color reproducibility is lower than those realized by the ordinary color printing, color photography or color CRT image.

Examples of colorants used after the transfer of the image onto the recording paper by means of the thermal transfer color ink sheet are given in a report of Inada, Wakatsuki and Takahashi entitled "Color hard copy of optical photography system" in the proceeding of The First Non-Impact Printing Technique Symposium (promoted by the Society of Electrophotography of Japan on July 24, 1984) and also in Japanese Patent Laid-Open Publication Nos. 220788/1983, 93390/1984 and 93391/1984.

However, the above prior documents contain no disclosure with respect to a spectral reflectance aspect. Furthermore, a color ink sheet shown in the above prior documents has a narrow color specification range and a low color reproducibility as a whole.

SUMMARY OF THE INVENTION

An object of the present invention is to provide a color ink sheet for thermal transfer having a wide color specification range and capable of forming a clear image having an excellent color reproducibility.

The present invention provides a color ink sheet for thermal transfer comprising thermal transfer ink layers containing at least three colorants, i.e. yellow, magenta and cyan colorants, provided on a base substance, characterized in that when the reflection density of the colorants is 1.3 after transfer onto a recording paper, a spectral reflectance y (%) of the yellow colorant transferred onto the recording paper lies in between two diagrams represented by the following formulae (1) and (2), a spectral reflectance y (%) of magenta colorant transferred onto the recording paper lies in between two diagrams represented by the following formulae (3) and (4), and a spectral reflectance y (%) of cyan colorant transferred onto the recording paper lies in between two diagrams represented by the following formulae (5) and (6):

$$(1)\begin{cases} y = -\frac{2}{3}(x-400)+30 & \ldots 400 \leqq x \leqq 430 \\ y = 10 & \ldots 430 \leqq x \leqq 440 \\ y = \frac{17}{12}(x-440)+10 & \ldots 440 \leqq x \leqq 500 \\ y = 95 & \ldots 500 \leqq x \leqq 700 \end{cases}$$

$$(2)\begin{cases} y = 5 & \ldots 430 \leqq x \leqq 490 \\ y = 2(x-490)+5 & \ldots 490 \leqq x \leqq 530 \\ y = 85 & \ldots 530 \leqq x \leqq 700 \end{cases}$$

$$(3)\begin{cases} y = -\frac{5}{12}(x-400)+80 & \ldots 400 \leqq x \leqq 460 \\ y = -\frac{9}{10}(x-510)+10 & \ldots 460 \leqq x \leqq 510 \\ y = 10 & \ldots 510 \leqq x \leqq 560 \\ y = \frac{17}{4}(x-560)+10 & \ldots 560 \leqq x \leqq 580 \\ y = 95 & \ldots 580 \leqq x \leqq 700 \end{cases}$$

$$(4)\begin{cases} y = \frac{3}{8}(x-400)+20 & \ldots 400 \leqq x \leqq 440 \\ y = -\frac{3}{4}(x-480)+5 & \ldots 440 \leqq x \leqq 480 \\ y = 5 & \ldots 480 \leqq x \leqq 600 \\ y = \frac{8}{5}(x-600)+5 & \ldots 600 \leqq x \leqq 650 \\ y = 85 & \ldots 650 \leqq x \leqq 700 \end{cases}$$

$$(5)\begin{cases} y = \frac{1}{2}(x-400)+60 & \ldots 400 \leqq x \leqq 450 \\ y = 85 & \ldots 450 \leqq x \leqq 470 \\ y = -\frac{1}{2}(x-620)+10 & \ldots 470 \leqq x \leqq 620 \\ y = 10 & \ldots 620 \leqq x \leqq 660 \\ y = \frac{11}{8}(x-660)+10 & \ldots 660 \leqq x \leqq 700 \end{cases}$$

-continued $$(6)\begin{cases} y = \frac{2}{3}(x - 400) + 20 & \ldots 400 \leqq x \leqq 460 \\ y = -\frac{11}{20}(x - 560) + 5 & \ldots 460 \leqq x \leqq 560 \\ y = 5 & \ldots 560 \leqq x \leqq 700 \end{cases}$$

wherein x represents a light wavelength (nm).

Here, the reflection density defines as amount of $-\log(y'/100)$, where y' is a minimum value of the spectral reflectance. When y' is 5 (%) the reflection density becomes 1.3.

The inventors have found that when the respective colorants having the spectral reflectances lying in between two diagrams represented by the above-mentioned formulae are used, a color ink sheet for thermal transfer capable of realizing excellent hues when the colors of yellow, magenta, cyan, red, blue and green colorants are recorded on the recording paper, also capable of realizing an appropriate hue, a high Y-Value (Luminance factor) and a high chroma, i.e. a wide color specification range and capable of forming clear image having a high color reproducibility can be obtained.

DETAILED DESCRIPTION OF PREFERRED EMBODIMENTS

Figure 1:
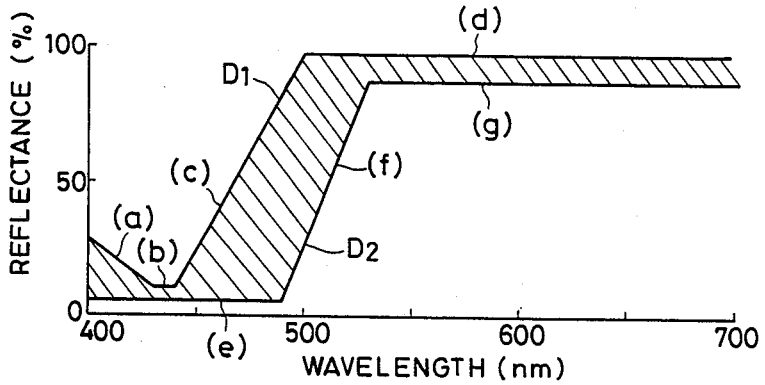
FIGS. 1, 2 and 3 are diagrams showing respectively the reflection spectrum range realized when the minimum spectral reflectance of each of yellow, magenta and cyan according to the above formulae (1) to (6) is 5%.

The present invention provide a yellow colorant provided on the base substance, when the reflection density of the yellow colorant is 1.3 after the transfer onto the recording paper, wherein a spectral reflectance y (%) of lies in between two diagrams represented by following formulae (1) and (2).

$$(1)\begin{cases} y = -\frac{2}{3}(x - 400) + 30 & \ldots 400 \leqq x \leqq 430 \quad (a) \\ y = 10 & \ldots 430 \leqq x \leqq 440 \quad (b) \\ y = \frac{17}{12}(x - 440) + 10 & \ldots 440 \leqq x \leqq 500 \quad (c) \\ y = 95 & \ldots 500 \leqq x \leqq 700 \quad (d) \end{cases}$$

-continued $$(2)\begin{cases} y = 5 & \ldots 400 \leqq x \leqq 490 \quad (e) \\ y = 2(x - 490) + 5 & \ldots 490 \leqq x \leqq 530 \quad (f) \\ y = 85 & \ldots 530 \leqq x \leqq 700 \quad (g) \end{cases}$$

wherein x represents a light wavelength (nm).

FIG. 1 shows diagrams illustrating the reflection spectrum range realized when the minimum spectral reflectance of the yellow according to the above formulae (1) and (2) is 5%.

A diagram $D_1$ shown in FIG. 1 shows a diagram according to the above formula (1) containing (a), (b), (c) and (d). A diagram $D_2$ shown in FIG. 1 shows a diagram according to the above formula (2) containing (e), (f) and (g).

The present invention provide a magenta colorant provided on the base substance, when the reflection density of the magenta colarant is 1.3 after the transfer onto the recording paper, wherein a spectral reflectance y (%) of lies in between two diagrams represented by following formulae (3) and (4).

$$(3)\begin{cases} y = -\frac{5}{12}(x - 400) + 80 & \ldots 400 \leqq x \leqq 460 \quad (h) \\ y = -\frac{9}{10}(x - 510) + 10 & \ldots 460 \leqq x \leqq 510 \quad (i) \\ y = 10 & \ldots 510 \leqq x \leqq 560 \quad (j) \\ y = \frac{17}{4}(x - 560) + 10 & \ldots 560 \leqq x \leqq 580 \quad (k) \\ y = 95 & \ldots 580 \leqq x \leqq 700 \quad (l) \end{cases}$$

$$(4)\begin{cases} y = \frac{3}{8}(x - 400) + 20 & \ldots 400 \leqq x \leqq 440 \quad (m) \\ y = -\frac{3}{4}(x - 480) + 5 & \ldots 440 \leqq x \leqq 480 \quad (n) \\ y = 5 & \ldots 480 \leqq x \leqq 600 \quad (o) \\ y = \frac{8}{5}(x - 600) + 5 & \ldots 600 \leqq x \leqq 650 \quad (p) \\ y = 85 & \ldots 650 \leqq x \leqq 700 \quad (q) \end{cases}$$

wherein x represents a light wavelength (nm).

Figure 2:
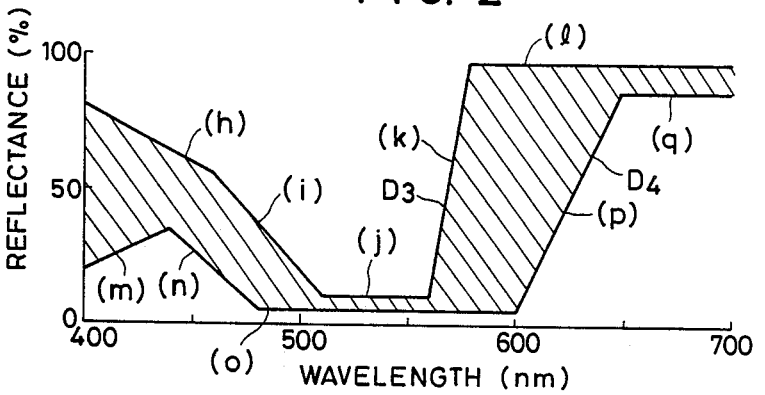

FIG. 2 shows diagrams illustrating the reflection spectrum range realized when the minimum spectral reflectance of the magenta according to the above formulae (3) and (4) is 5%.

A diagram $D_3$ shown in FIG. 2 shows a diagram according to the above formula (3) containing (h), (i), (j), (k) and (l). A diagram $D_4$ shown in FIG. 2 shows a diagram according to the above formula (4) containing (m), (n), (o), (p) and (q).

The present invention provides a cyan colorant provided on the base substance, when the reflection density of the cyan colarant is 1.3 after the transfer onto the recording paper, wherein a spectral reflectance y (%) of lies in between two diagrams represented by following formulae (5) and (6).

$$(5)\begin{cases} y = \frac{1}{2}(x - 400) + 60 & \ldots 400 \leqq x \leqq 450 \quad (r) \\ y = 85 & \ldots 450 \leqq x \leqq 470 \quad (s) \\ y = -\frac{1}{2}(x - 620) + 10 & \ldots 470 \leqq x \leqq 620 \quad (t) \\ y = 10 & \ldots 620 \leqq x \leqq 660 \quad (u) \\ y = \frac{11}{8}(x - 660) + 10 & \ldots 660 \leqq x \leqq 700 \quad (v) \end{cases}$$

$$(6)\begin{cases} y = \frac{2}{3}(x - 400) + 20 & \ldots 400 \leqq x \leqq 460 \quad (w) \\ y = -\frac{11}{20}(x - 560) + 5 & \ldots 460 \leqq x \leqq 560 \quad (x) \\ y = 5 & \ldots 560 \leqq x \leqq 700 \quad (y) \end{cases}$$

wherein x represents a light wavelength (nm).

Figure 3:
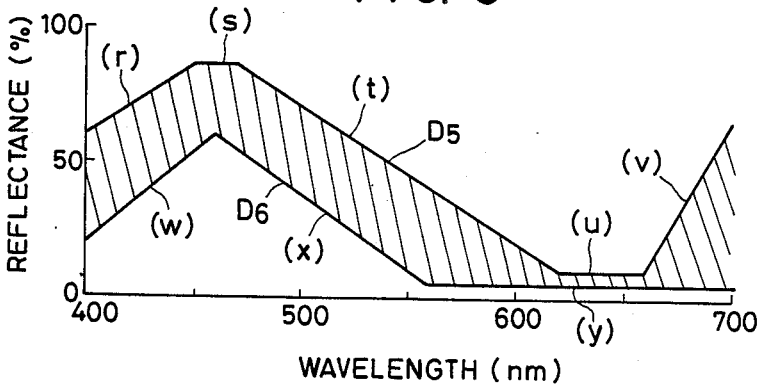

FIG. 3 shows diagrams illustrating the reflection spectrum range realized when the minimum spectral reflectance of the cyan according to the above formulae (5) and (6) is 5%.

A diagram $D_5$ shown in FIG. 3 shows a diagram according to the above formula (5) containing (r), (s), (t), (u) and (v). A diagram $D_6$ shown in FIG. 3 shows a diagram according to the above formula (6) containing (w), (x) and (y).

It was confirmed that even when the reflection density after the transfer of yellow, magenta and cyan was not 1.3, a wide color specification range and excellent color definition and color reproducibility can be realized at the corresponding reflection density when the reflection spectrum at the reflection density of 1.3 is as defined in the previous mentioned formulae.

To obtain the colorants having the spectral reflectances within the hatched parts shown in FIGS. 1, 2 and 3, the following conditions must be satisfied: as for yellow, the gradiant of the spectral reflectance y (%) against the light wavelength (nm) in the range of 400 to 530 nm must be higher than 1.00%/nm at the largest gradient, preferablely higher than 1.2%/nm, particularly higher than 1.5%/nm. As for magenta, the peak value of the spectral reflectance within the light wavelength range of 400 to 450 nm must be observed at a light wavelength of longer than 415 nm, particularly longer than 420 nm. As for cyan, the peak value of the spectral reflectance at a light wavelength within 400 to 500 nm must be at least 60%, particularly at least 70%.

Figure 4:
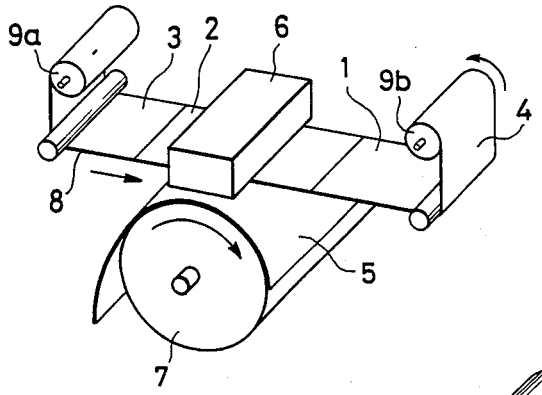
FIG. 4 is a structure view showing a principle of the color recording.

FIG. 4 shows an embodiment of the structure of a recording paper 5 and an ink sheet 4 according to the present invention which comprises ink layers 8 of a yellow layer 1, a magenta layer 2 and a cyan layer 3 arranged face to face repeatedly. The ink sheet 4 is fed from a sending roller 9*a* to a wind-up rollor 9*b*. The ink layers 8 are transferred onto the recording paper 5 by heating a thermal head 6.

The order and method of the arrangement of the three-color ink layers 1, 2 and 3 are not particularly limited. If necessary, another ink layer of, for example, black may be added thereto to form a laminate comprising a yellow layer, a magenta layer, a cyan layer and a black layer repeatedly.

Figure 5:
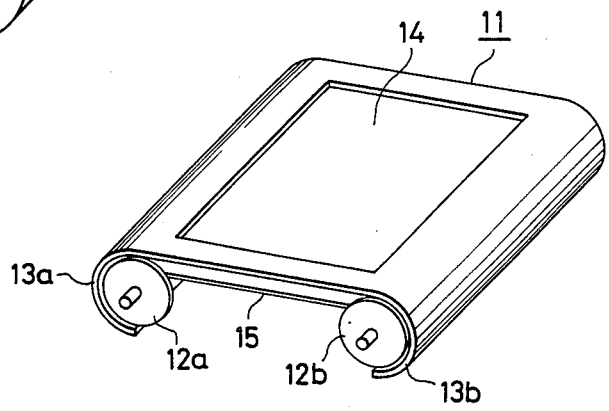
FIG. 5 is a squint view showing a cartridge for receiving an ink sheet for thermal transfer.

FIG. 5 is a squint view of a cartridge for receiving a color ink sheet for thermal transfer. A cartridge 11 comprises a pair of bobbins 12*a* and 12*b* and a pair of cylindrical portions 13*a* and 13*b* for disposing an ink sheet 15 at a predetermined interval. The ink sheet 15 is wound the bobbins 12*a* and 12*b* by the rotation of the bobbins 12*a* and 12*b*. The cartridge provides a window 14 for contacting the ink sheet 15. A thermal head contacts directly with the ink sheet through the window 14 so as to transfer an ink layer on a recording paper.

Figure 6:
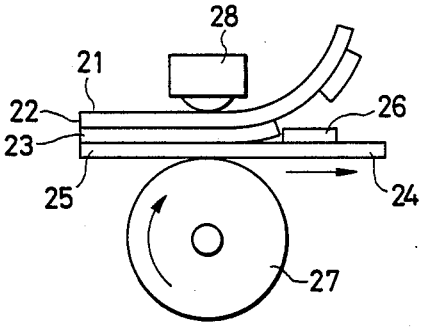
FIG. 6 is a transfer principle view of the fusion-type ink sheet and cross-sectional view of the ink sheet.

FIG. 6 is a transfer principle view of the fusion-type ink sheet, and cross-sectional view of the ink sheet. An ink sheet 21 comprises a base film 22 and an ink layer 23. A recorded recording paper 24 comprises a base substance 25 and a transferred ink layer 26. The recording paper 24 is fed by a platen roller 27. The transfer ink layer 26 is formed on the recording paper 24 by transferring an ink layer 23 on the recording paper 24 according to heating of a thermal head 28. The various colors are printed on the recording paper 24 by the superposition of each of yellow, magenta and cyan layers being disposed in the ink layer 23 of the ink sheet 21.

Figure 7:
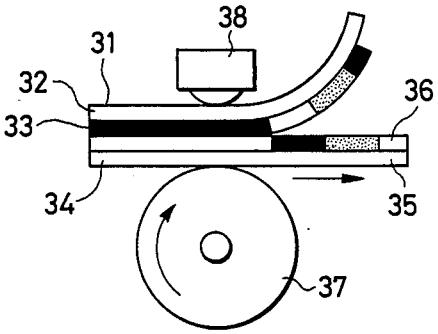
FIG. 7 is a transfer principle view of the sublimation-type ink sheet and cross-sectional view of the ink sheet.

FIG. 7 is a transfer principle view of the sublimation-type ink sheet and cross-sectional view of the ink sheet. An ink sheet 31 comprises a base substance or base film 32 and an ink layer 33. A recorded recording paper 34 comprises a base 35 and a dyed layer 36. The recording paper 34 is fed by a platen roller 37. A sublimating dye in the ink layer 33 sublimates or evaporates by heating through a thermal head 38 and disperses into the dyed layer 36 of the recording paper 34. Thus a coloring portion is formed on the recording paper 34. The density of the coloring portion is controlled by the length of the heating time of the thermal head 38. The various colors are printed on the recording paper 34 by the superposition of each shade of yellow, magenta and cyan.

In both above mentioned transfer methods, the ink layer 23 and 33 containing the colorants of the present invention is provided on the base substance 25 and 35, respectively. The base substance 25 and 35 may be the same as that used widely as a base of an ordinary thermal transfer ink sheet made of a condenser paper or plastic sheet such as a polyester sheet, polyimide sheet or other high-molecular weight material sheet. The thickness of the ink sheet is preferable more thin in the thermal conduction aspect. The polyester film has a thickness of 3–10 μm is preferable for practical use in the strength etc. aspects.

The ink layer 23 of the fusion-type contains, in addition to the colorants, a binder comprising a substance fusible by heat such as a wax, e.g. paraffin wax, and a fatty acid ester. The ink layer 33 of the sublimation type contains at least a high-molecular material such as polyester, polyamide, acrylic polymer or cellulose as a binder. The amount of the colorant is 1–70 wt % of the total of the ink layer 23 or 33 and, particularly is preferably 10–50 wt %. The thickness of the ink layer 23 or 33 is preferably 0.5–2 μm.

The ink layer 23 or 33 may further contain various additives such as a surfactant or highly heat-conductive, fine particles. A heat-resistant layer such as a silicone resin layer which prevents sticking may be formed on the other, ink layer-free surface of the base substance 25 or 35.

Particularly when an ink sheet of the sublimation type is used, the hue realized after the transfer varies frequently depending on the variety of the material forming the surface of the recording paper and the presence or absence of a developer in the surface layer of the recording paper even when a given sublimation dye is used. When the material forming the surface of the recording paper varies, a colorant such as sublimation dye may be selected suitably depending on the material. It is not limited by the material of the recording paper.

When the ink sheet of the sublimation type of the present invention is used for the transfer onto a recording paper comprising a paper having a high whiteness, such as polypropylene synthetic paper coated with a thin layer of a polyester resin as the dyed layer (trade name: Vylon 200; a product of Toyobo Co., Ltd.), the following dyes may be used: PTY-21 (a product of Mitsubishi Chemical Industries), LSD Y-902 (Nippon Kayaku Co., Ltd.) and NK-1581 and GY-9 (Nippon Kanko Shikiso Kenkyu-jo) for yellow; LSD R-901 and Kayaset R-130 (Nippon Kayaku Co., Ltd.) and NK-1584 (Nippon Kanko Shikiso Kenkyu-jo) for magenta; and Kayaset B-136, Kayaset B-776 and Kayaset B-814 (Nippon Kayaku Co., Ltd.) and NK-1156 (Nippon Kanko Shikiso Kenkyu-jo) for cyan.

The chemical structures of the dyes are as follows:

NK-1581

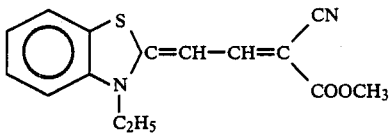

GY-9

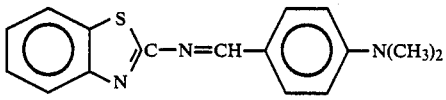

LSD R-901

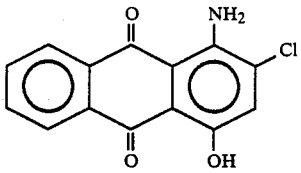

NK-1584

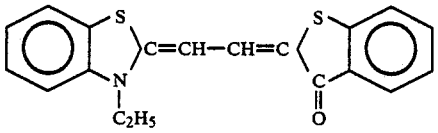

Kayaset B-136

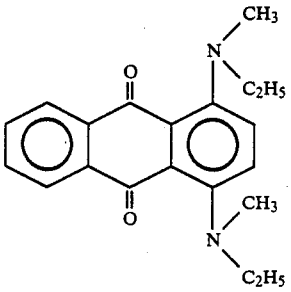

Kayaset B-766

-continued

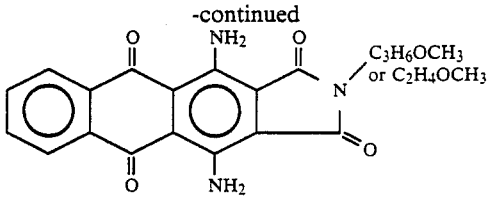

Kayaset B-814

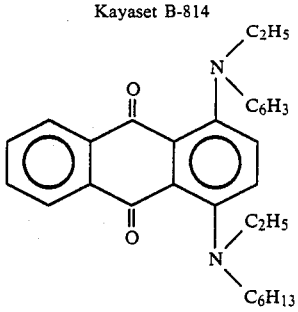

NK-1156

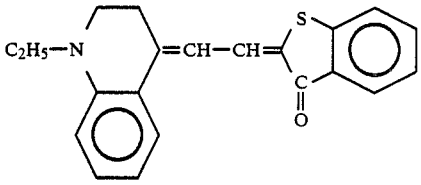

EXAMPLE 1

LSD Y-902, LSD R-901 and Kayaset B-814 (products of Nippon Kayaku Co., Ltd.) were used as the yellow, magenta and cyan dyes, respectively. Three colored ink solutions each comprising 1 part by weight of the dye, 2 parts by weight of a binder (Vylon 290; a product of Toyobo Co., Ltd.) and 27 parts by weight of tetrahydrofuran were prepared. The ink solutions were coated to a polyethylene terephthalate sheet having a thickness of 6 μm successively so that layers having each a thickness of about 1 μm after drying and arranged face to face would be formed. After drying, a color ink sheet of the sublimation type for the thermal transfer was obtained.

A recording paper used was prepared by applying a solution of 2 parts by weight of a polyester resin (Vylon 200, a product of Toyobo Co., Ltd.) in 8 parts by weight of methyl ethyl ketone to a synthetic polypropylene paper (FPG-150; a product of Ohji Yuka Seishi Co.,) and drying the same (the coating film thickness after the drying: about 2 μm). The recording paper and the ink sheet were put together in such a manner that the coating film surface of the former was in close contact with the surface of the ink layer of the latter.

A metal rod having a diameter of 10 mm and kept at a given temperature of 120° C. with a built-in heater was pressed under a load of 500 g on the yellow, magenta and cyan parts of the ink sheet on its base side. The pressing time was varied in the range of about 0.3 to 3 sec. and those having a reflection density of 1.3 when the minimum spectral reflection was 5%, i.e. at a light wavelength at which the minimum spectral reflectance could be observed were selected.

Figure 8:
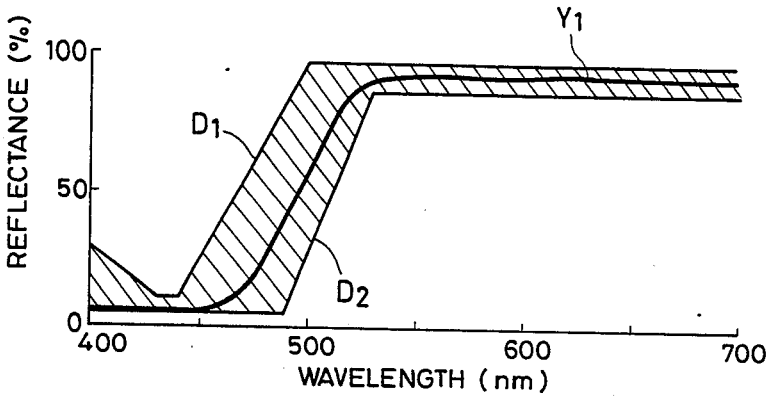
FIGS. 8, 9 and 10 are diagrams showing respectively the reflection spectrum range of yellow, magenta or cyan dye realized after the transfer on a recording paper with the ink sheet prepared in Example 1.
Figure 9:
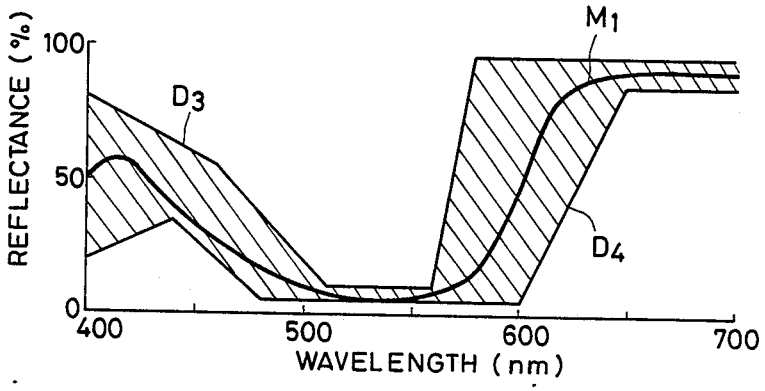
Figure 10:
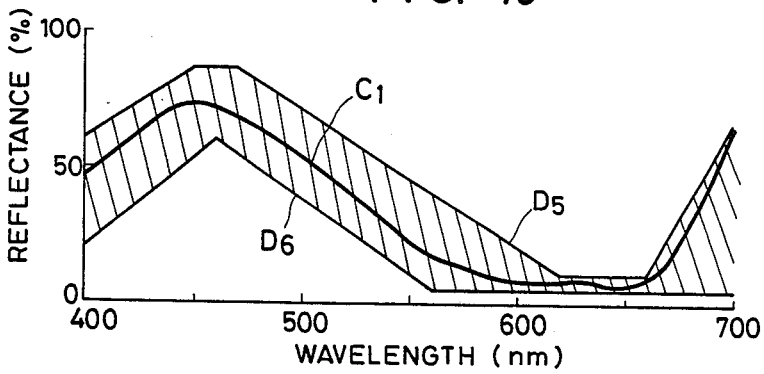

The reflection spectrum diagrams of the yellow, magenta and cyan realized when the reflection density is 1.3 are shown as $Y_1$, $M_1$ and $C_1$ in FIGS. 8, 9 and 10, respectively. These reflection spectra $Y_1$, $M_1$ and $C_1$ lie within the hatched parts defined by the formulae (1) to (6) in the FIGS. 1, 2 and 3. The dominant wavelength, Y-Value (Luminance factor) and excitation purity of each color were calculated from these reflection spectra and red, green and blue reflection spectra obtained after the transfer of combinations of two superposed colors, i.e. yellow/magenta, yellow/cyan and magenta/cyan under a transfer condition of the reflection density of 1.3 was obtained in the same manner as above. The results are shown in Table 1.

TABLE 1

| Color | Dominant wavelength (nm) | Y (%) | Excitation purity (%) |
|---|---|---|---|
| Yellow | 572 | 84 | 78 |
| Magenta | 505* | 21 | 59 |
| Cyan | 478 | 24 | 62 |
| Red | 605 | 18 | 84 |
| Green | 534 | 18 | 38 |
| Blue | 430 | 3 | 74 |

*Dominant wavelength of complementary color

The larger the sum addition value of Y-Value and excitation purity with respect to each color shown in Table 1, the more the high color reproducibility with respect to each color can be obtained. Further the larger the sum total addition value of Y-Value and excitation purity with respect to yellow, magenta, cyan, red, green and blue, the more the total color specification range is wide. The comparison of the addition value of Example 1 with that of the latter mentioned Comparative Example is as follows: as for yellow, 162, 150; as for magenta, 80, 77; as for cyan, 86, 82; as for red, 102, 110; as for green 56, 31; and as for blue 77, 75. The addition values of Example 1 with respect to each color are larger than that of Comparative Example, except for red. The sum total addition values of Example 1 and Comparative Example are 563 and 525, respectively. The sum total addition value of Example 1 is larger than that of Comparative Example, therefore, the color specification range of Example 1 is wider than that of Comparative Example. Furthermore, the comparison of the value of the dominant wavelength of Example 1 with that of Comparative Example is as follows. In the Comparative Example, the yellow is a yellow inclining to orange, red is a red inclining to orange, green is a green inclining to blue and blue is blue inclining to purple. Therefore, the hues of Example 1 are excellent.

It is apparent from FIG. 8 that the gradiant of the spectral reflectance, y (%), in the range of 460 to 515 nm for yellow was 1.67. In FIG. 9, the peak value of the spectral reflectance of magenta at around 405 nm was as high as 58%. In FIG. 10, the peak value of the spectral reflectance of cyan at 450 nm was as high as 73%. Thus, when the ink sheet prepared in Example 1 was used, the obtained transferred record had an accurate hue, wide color specification range, high definition and an excellent color reproducibility of the original. The product had a particularly wide specification range and high definition for green.

EXAMPLE 2

An ink sheet was prepared in the same manner as in Example 1 except that GY-9 (a product of Nippon Kanko Shikiso Kenkyu-jo) was used as the yellow dye, NK-1584 (a product of Nippon Kanko Shikiso Kenkyu-jo) was used as the magenta dye and Kayaset B-776 (a product of Nippon Kayaku Co., Ltd.) was used as the cyan dye. The same test as in Example 1 was repeated.

Figure 11:
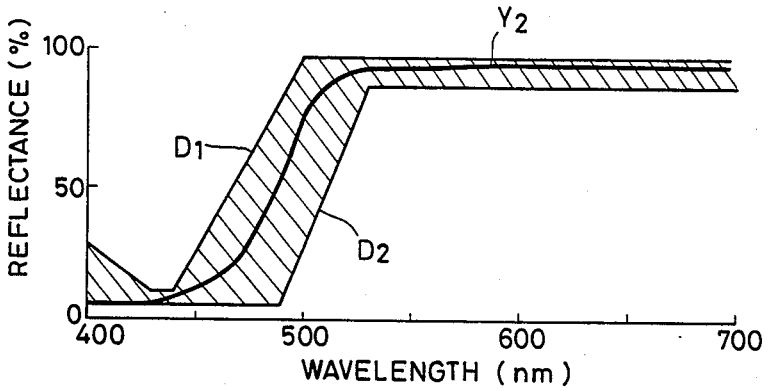
FIGS. 11, 12 and 13 are diagrams showing respectively the reflection spectrum range realized when the ink sheet prepared in Example 2 was used.
Figure 12:
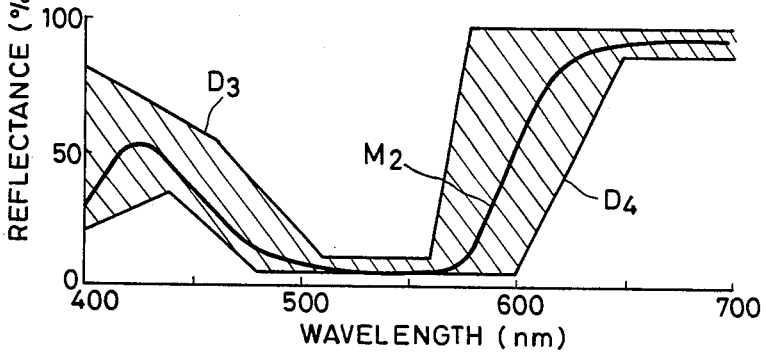
Figure 13:
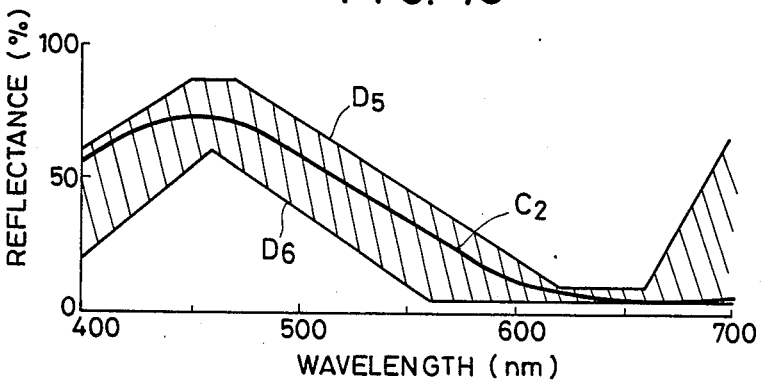

The reflection spectra of the yellow, magneta and cyan dyes are shown as $Y_2$, $M_2$ and $C_2$ in FIGS. 11, 12 and 13, respectively. These reflection spectra $Y_2$, $M_2$ and $C_2$ lie within the hatched ranges in FIGS. 1, 2 and 3. The dominant wavelength, Y-Value and excitation purity of each color calculated from the reflection spectra of yellow, magenta, cyan, red, green and blue dyes after the transfer onto the recording papers are shown in Table 2.

TABLE 2

| Color | Dominant wavelength (nm) | Y (%) | Excitation purity (%) |
|---|---|---|---|
| Yellow | 571 | 87 | 69 |
| Magenta | 507* | 20 | 62 |
| Cyan | 481 | 31 | 53 |
| Red | 609 | 17 | 77 |
| Green | 531 | 26 | 34 |
| Blue | 421 | 4 | 71 |

*Dominant wavelength of complementary color

As shown in FIG. 11, the gradient of the spectral reflectance, y (%), at a wavelength, x, in the range of 445 to 550 nm was 1.82 at maximum portion. As shown in FIG. 12, the peak value of the spectral reflectance of magenta in the range of 400 to 450 nm was recognized at 425 nm. As shown in FIG. 13, the peak value of the spectral reflectance of the cyan at 450 nm was 72%.

These results suggested that when the ink sheet prepared in Example 2 was used, the obtained transferred record had an accurate hue, a wide color specification range, a high definition and an excellent color reproducibility of the original. The product had a particularly wide specification range and high definition for green.

As shown in Table 2, the sum of Y (%) value and excitation purity (%) value of the six colors is 551. This sum value of Example 2 is larger than that (525) of the latter mentioned Comparative Example. Therefore the color specification range of Example 2 is wide as a whole.

According to the present invention, transfer recording is possible over the whole density range to obtain an accurate hue, a wide color specification range, a high definition and excellent color reproducibility. Particularly when the thermal transfer color ink sheet of the present invention is used, a wide color specification range for green and a clear transferred record can be obtained, while the color specification range for green realized by the ordinary thermal transfer recording was narrow.

According to the ink sheet of the present invention, in which the colorants have the spectral reflectance defined by the above mentioned formulae (1) to (6), the ink sheet is not limited only the sublimation type dye. Also when the ink sheets of the fusion-type were used, a a wide color specification range and an excellent color reproducibility were obtained.

Further, by utilizing the colorants having, as for yellow, the gradient of the spectral reflectance against the light wavelength, as for magenta, the peak value of the spectral reflectance within the light wavelength range of 400 to 50 nm, and as for cyan, the peak value of the spectral reflectance within the light wavelength range of 400 to 500 nm, respectively, the fusion-type ink sheet has similar effects as those of the sublimation-type dye.

Comparative Example

An ink sheet was prepared in the same manner as in Example 1 except that Solvent Yellow 16 (Color Index), Disperse Red 59 (Color Index) and Disperse Blue 3 (Color Index) were used as the yellow, magenta and cyan dyes, respectively, and the same tests as in Example 1 were effected.

Figure 14:
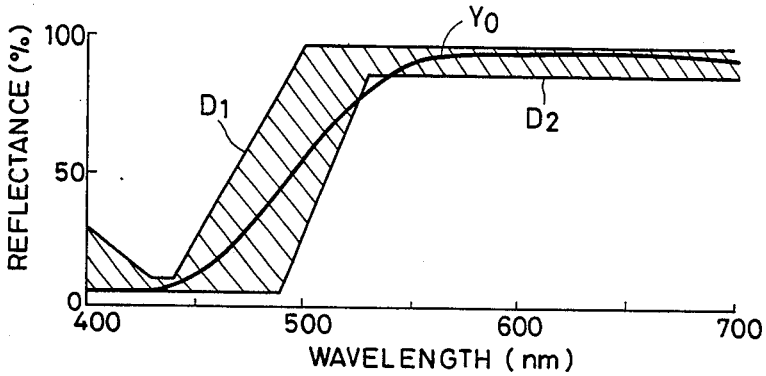
FIGS. 14, 15 and 16 are diagrams showing respectively the reflection spectrum range realized when the ink prepared in Comparative Example was used.
Figure 15:
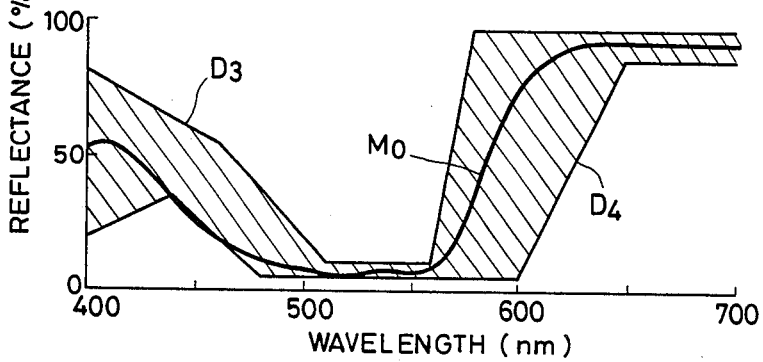
Figure 16:
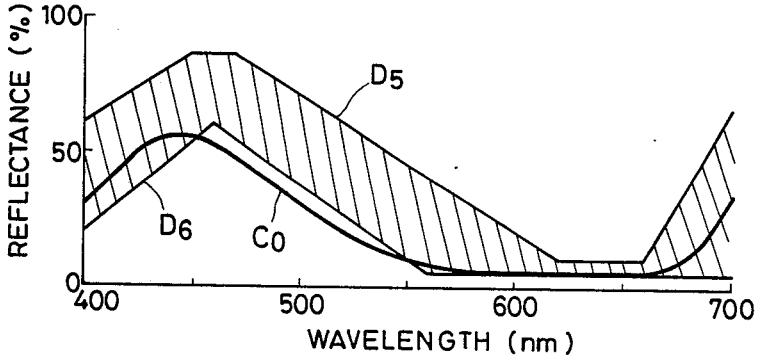

The reflection spectra of yellow, magenta and cyan are shown as Yo, Mo and Co in FIGS. 14, 15 and 16, respectively. A part of each reflection spectrum Yo, Mo and Co was outside the hatched range in FIGS. 1, 2 or 3. The dominant wavelength, Y-Value and excitation purity of each color calculated from the reflection spectra of yellow, magenta, cyan, red, green and blue dyes after the transfer onto the recording papers are shown in Table 3.

TABLE 3

| Color | Dominant wavelength (nm) | Y (%) | Excitation purity (%) |
|---|---|---|---|
| Yellow | 574 | 81 | 69 |
| Magenta | 496* | 27 | 50 |
| Cyan | 473 | 13 | 69 |
| Red | 602 | 24 | 86 |
| Green | 502 | 9 | 22 |
| Blue | 565* | 2 | 73 |

*Dominant wavelength of complementary color

The results shown in Table 3 suggested that though the excitation purity (i.e. chroma) or Y-Value of some of the six colors was higher than those obtained in Example 2, the color specification range was narrow on the whole and particularly the green color was darker than that of the original and its color reproducibility was poor.

In FIG. 14, as for yellow, the spectral reflectance within the light wavelength range of 444 to 546 nm is 0.94 (%n/m) at the largest portion. As for magenta, the peak value of the spectral reflectance within the light wavelength range of 400 to 500 nm is under 410 nm. As for cyan, the peak value of the spectral reflectance within the light wavelength range of 400 to 500 nm is 56%.

We claim:

1. A color ink sheet for thermal transfer comprising thermal transfer ink layers containing at least three colorants comprising a yellow colorant, a magenta colorant and a cyan colorant provided on a base sheet, the yellow, magenta and cyan colorants comprising sublimation dyes, characterized in that when the reflection density of the colorants is 1.3 after the transfer onto a recording paper, a spectral reflectance y (%) of the yellow colorant lies in between two diagrams represented by the following formulae (1) and (2), a spectral reflectance y (%) of the magenta colorant lies in between two diagrams represented by the following formulae (3) and (4), and a spectral reflectance y (%) of the cyan colorant lies in between two diagrams represented by the following formulae (5) and (6):

$$(1)\begin{cases} y = -\frac{2}{3}(x-400)+30 & \ldots 400 \leqq x \leqq 430 \\ y = 10 & \ldots 430 \leqq x \leqq 440 \\ y = \frac{17}{12}(x-440)+10 & \ldots 440 \leqq x \leqq 500 \\ y = 95 & \ldots 500 \leqq x \leqq 700 \end{cases}$$

-continued $$(2)\begin{cases} y = 5 & \ldots 430 \leqq x \leqq 490 \\ y = 2(x-490)+5 & \ldots 490 \leqq x \leqq 530 \\ y = 85 & \ldots 530 \leqq x \leqq 700 \end{cases}$$

$$(3)\begin{cases} y = -\frac{5}{12}(x-400)+80 & \ldots 400 \leqq x \leqq 460 \\ y = -\frac{9}{10}(x-510)+10 & \ldots 460 \leqq x \leqq 510 \\ y = 10 & \ldots 510 \leqq x \leqq 560 \\ y = \frac{17}{4}(x-560)+10 & \ldots 560 \leqq x \leqq 580 \\ y = 95 & \ldots 580 \leqq x \leqq 700 \end{cases}$$

$$(4)\begin{cases} y = \frac{3}{8}(x-400)+20 & \ldots 400 \leqq x \leqq 440 \\ y = -\frac{3}{4}(x-480)+5 & \ldots 440 \leqq x \leqq 480 \\ y = 5 & \ldots 480 \leqq x \leqq 600 \\ y = \frac{8}{5}(x-600)+5 & \ldots 600 \leqq x \leqq 650 \\ y = 85 & \ldots 650 \leqq x \leqq 700 \end{cases}$$

$$(5)\begin{cases} y = \frac{1}{2}(x-400)+60 & \ldots 400 \leqq x \leqq 450 \\ y = 85 & \ldots 450 \leqq x \leqq 470 \\ y = -\frac{1}{2}(x-620)+10 & \ldots 470 \leqq x \leqq 620 \\ y = 10 & \ldots 620 \leqq x \leqq 660 \\ y = \frac{11}{8}(x-660)+10 & \ldots 660 \leqq x \leqq 700 \end{cases}$$

$$(6)\begin{cases} y = \frac{2}{3}(x-400)+20 & \ldots 400 \leqq x \leqq 460 \\ y = -\frac{11}{20}(x-560)+5 & \ldots 460 \leqq x \leqq 560 \\ y = 5 & \ldots 560 \leqq x \leqq 700 \end{cases}$$

wherein x represents a light wavelength (nm), and wherein said yellow colorant comprises a material selected from the group consisting of

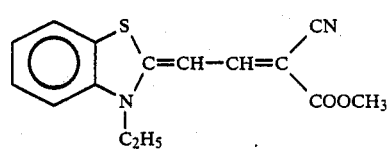

and

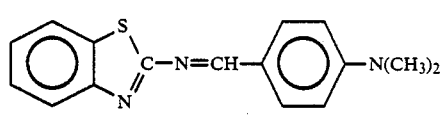

said magenta colorant comprises a material selected from the group consisting of

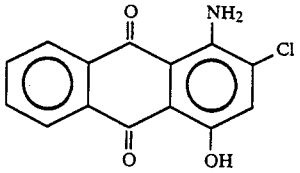

and

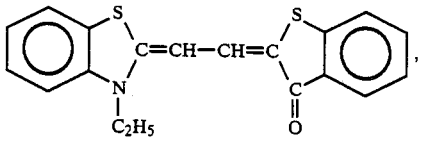

and said cyan colorant comprises a material selected from the group consisting of

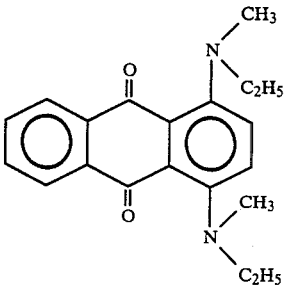

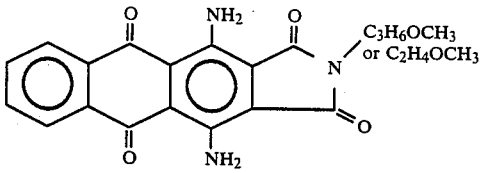

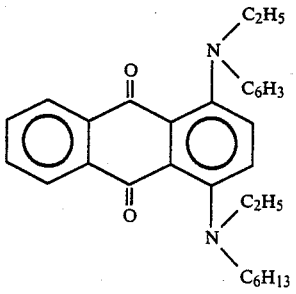

and

-continued

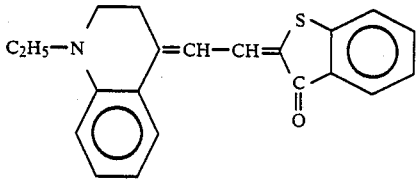

2. A color ink sheet for thermal transfer according to claim 1, wherein said base sheet comprises a film having 4–10 μm thickness, said film being a condenser paper or one selected from a high-molecular material of polyester, polyimide and cellulose; said ink layer comprises said colorant and a binder and has a 0.5–2 μm thickness; and an amount of said colorant is 1–70% by weight.

3. A color ink sheet for thermal transfer according to claim 2, wherein said binder is one selected from a high-molecular material of polyester, polyamide, acrylic resin and cellulose.

4. A color ink sheet for thermal transfer according to claim 1, wherein when the reflection density of the colorants is 1.3 after the transfer onto a recording paper; as for yellow, a gradient of a spectral reflectance against a light wavelength (nm) in a range of 400 to 500 nm is higher than 1.00 (%/nm); as for magenta, a peak value of a spectral reflectance within a light wavelength range of 400 to 450 nm is at a light wavelength of longer than 415 nm; and as for cyan, a peak value of a spectral reflectance at a light wavelength within 400 to 500 nm is at least 60%.

5. A color ink sheet for thermal transfer according to claim 4, wherein said base sheet comprises a film having 4–10 μm thickness, said film being a condenser paper or one selected from a high-molecular material of polyester, polyimide and cellulose; said ink layer comprises said colorant and a binder and has a 0.5–2 μm thickness; and an amount of said colorant is 1–70% by weight.

6. A color ink sheet for thermal transfer according to claim 5, wherein said binder is one selected from a high-molecular material of polyester, polyamide, acrylic resin and cellulose.

7. A color ink sheet for thermal transfer according to claim 1, further comprising a black ink layer provided on said base sheet.

8. A color ink sheet for thermal transfer according to claim 1, wherein each of said thermal transfer ink layers comprises one of said yellow colorant, said magenta colorant and said cyan colorant, and a binder, the amount of the respective colorant being 10 to 50 wt. % of the total weight of the respective ink layer.

9. A color ink sheet for thermal transfer according to claim 8, wherein each of said thermal transfer ink layers further comprises a surfactant.

10. A color ink sheet for thermal transfer according to claim 8, wherein each of said thermal transfer ink layers further comprises heat-conductive, fine particles.

11. A color ink sheet for thermal transfer according to claim 1, further comprising a heat-resistant layer provided on a side of said base sheet opposite said side on which said thermal transfer ink layers are provided.

12. A color ink sheet for thermal transfer according to claim 11, wherein said heat-resistant layer is a silicone resin layer.

* * * * *